United States Patent [19]

Boettcher et al.

[11] 4,406,228

[45] Sep. 27, 1983

[54] DEVICE FOR BURNING PYROTECHNIC MIXTURES IN A VERY LOW PRESSURE ENVIRONMENT

[75] Inventors: Woodrow Boettcher, San Jose; Emanuel Goldman, San Mateo; John A. Gallaghan, Ben Lomond, all of Calif.

[73] Assignee: The United States of America as represented by the Secretary of the Navy, Washington, D.C.

[21] Appl. No.: 821,163

[22] Filed: Apr. 22, 1969

[51] Int. Cl.[3] ..... F42B 11/24

[52] U.S. Cl. ..... 102/513; 149/15; 149/22; 149/41; 149/43; 149/108.2

[58] Field of Search ..... 149/22, 43, 15, 41, 149/44, 108.2; 102/60, 87, 513

[56] References Cited

U.S. PATENT DOCUMENTS 2,988,438 4/1957 Allovio ..... 149/43

3,212,441 10/1965 Rosenberg et al. ..... 102/87

*Primary Examiner*—Peter A. Nelson

*Attorney, Agent, or Firm*—Robert F. Beers; Ervin F. Johnston; Thomas Glenn Keough

[57] ABSTRACT

A pyrotechnic missile which includes a body, first and second pyrotechnic sheets disposed on said body, and an autoigniter mounted on the body for igniting the pyrotechnic sheets. The combination of pyrotechnic sheets are adapted to yield an abundance of electrons while burning in a vacuum. The first pyrotechnic sheet includes a binder, cesium dichromate, cesium nitrate, boron, and a metal fuel. The second pyrotechnic sheet includes a binder, cesium nitrate, and a metal fuel. The autoignitor is adapted to ignite in response to heat due to air friction.

9 Claims, 4 Drawing Figures

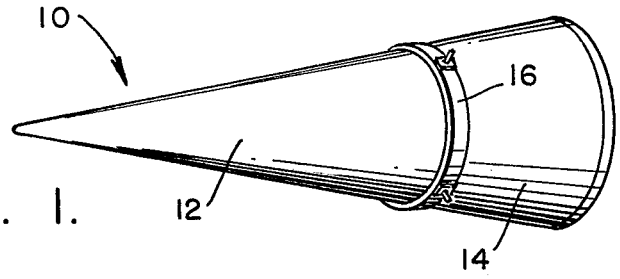
FIG. 1.
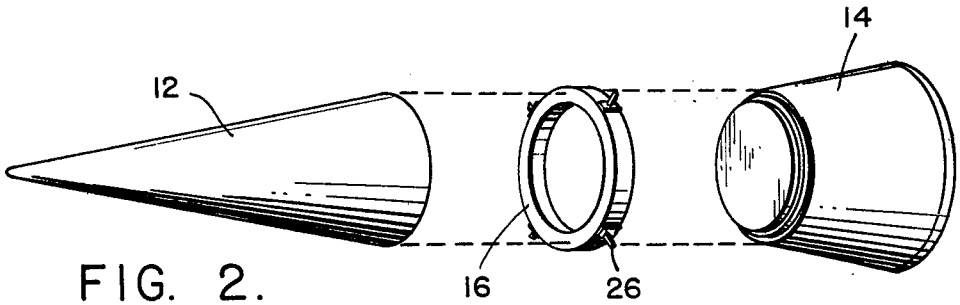
FIG. 2.
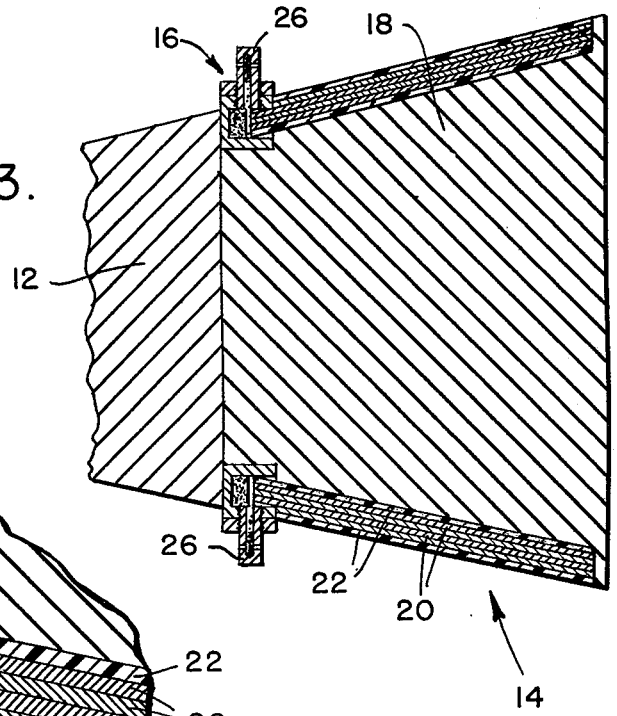
FIG. 3.
FIG. 4.
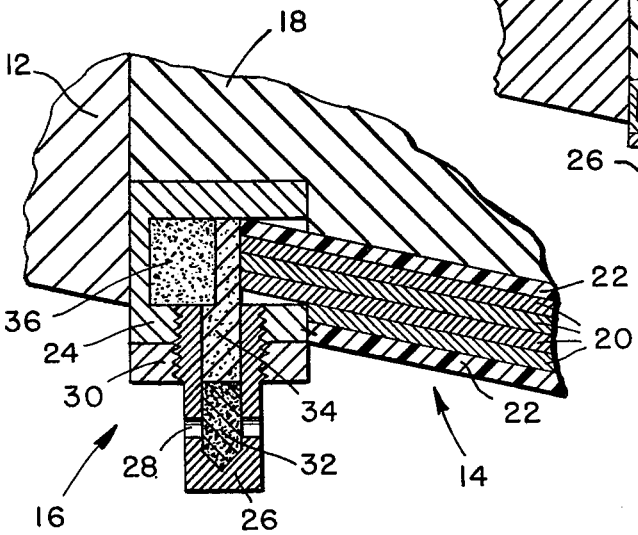

DEVICE FOR BURNING PYROTECHNIC MIXTURES IN A VERY LOW PRESSURE ENVIRONMENT

The invention described herein may be manufactured and used by or for the Government of the United States of America for governmental purposes without the payment of any royalties thereon or therefor.

In some instances it is desirable to provide a missile which, upon reentry towards the earth's surface, will ignite and burn in altitudes between 150,000 to 50,000 feet with a high electron output. We have found that by mounting pyrotechnic sheets of specific ingredients upon the missile body that this purpose can be achieved. These pyrotechnic sheets are mounted on the exterior surface of the missile body and accordingly it is important that they retain their sheet properties while burning within the aforementioned altitude range. One of the pyrotechnic sheets, or a plurality thereof, includes a binder, cenium dichromate, cesium nitrate, boron, and a metal fuel which is selected from the group consisting essentially of aluminum, magnesium, berrlium, and lithium. The other pyrotechnic sheet, or plurality thereof, includes a binder, cesium nitrate, and a metal fuel selected from the aforementioned group. The missile body may be a cone with the first mentioned pyrotechnic sheet or sheets sandwiched between a pair of the second mentioned pyrotechnic sheets on the surface of the cone. An autoigniter may be mounted on the cone adjacent to the pyrotechnic sheets for igniting the pyrotechnic sheets in response to heat due to air friction.

An object of the present invention is to provide a pyrotechnic missile which upon burning will produce a high yield of electrons in a vacuum environment;

Another object is to provide a pyrotechnic missile which will ignite automatically at an altitude between 150,000 feet to 50,000 feet and burn within this altitude range to produce a high yield of electrons;

A further object is to provide a pyrotechnic sheet which will produce a high yield of electrons while burning in a vacuum environment and which will retain its sheet-like qualities during this burning phase;

Still another object is to provide a combination of pyrotechnic sheets of differing mixtures wherein at least one of the pyrotechnic sheets will burn in a vacuum environment to produce a high yield of electrons and will sustain burning of at least one other pyrotechnic sheet of a differing mixture to produce an additional higher yield of electrons in the vacuum environment; and Other objects and many of the attendant advantages of this invention will be readily appreciated as it becomes better understood by reference to the description and accompanying drawings which follow.

FIG. 1 is a side isometric view of the pyrotechnic missile,

FIG. 2 is an isometric exploded view of the pyrotechnic missile,

FIG. 3 is a vertical cross-sectional view through the pyrotechnic missile, and

FIG. 4 is an enlarged view of a portion of FIG. 3 to illustrate pertinent details thereof.

Referring now the drawing wherein like reference numerals designate like or similar parts throughout the several views there is shown in FIG. 1 a pyrotechnic missile 10 which, as shown in FIG. 2, may be divided into forward and after conical sections 12 and 14. These sections may be solid and constructed of any suitable material such as aluminum, and may be joined together by an epoxy. Located between the conical sections 12 and 14 and recessed within the forward end of the after conical section 14 there may be an annular igniter 16 which will be described in detail hereinafter.

As shown in FIGS. 3 and 4, the after conical section 14 may include a conical body portion 18 upon which there is mounted about its surface a plurality of pyrotechnic sheets 20 and 22. The pyrotechnic sheets 20 may be sandwiched between a pair of pyrotechnic sheets 22 so that the innermost pyrotechnic sheet 22 forms a thermal barrier between the sheets 20 and the body 18 while the outside pyrotechnic sheet 22 forms an inhibitor layer between the sheets 20 and the outside environment. The pyrotechnic sheets 20 and 22 are composed of different mixtures in such a manner that they pyrotechnic sheets 20 aid in sustained burning of the inner and outer pyrotechnic sheets 22. The ingredients of the pyrotechnic sheet mixtures will be described in detail hereinbelow.

The autoigniter 16 has been provided to automatically ignite the pyrotechnic sheets 20 at altitudes between 150,000 to 50,000 feet in response to heat caused by air friction. The autoigniter 16 may include a hollow ring 24 which is open at an after end to receive forward ends of the pyrotechnic sheets 20 as well as the inner pyrotechnic sheet 22. A plurality of hollow plugs 26 may be partially threaded into the hollow ring 16 so that their hollow portions are in communication with the hollow ring 16. Each of the plugs 26 has an exterior portion which extends radially outwardly from the ring 24 and which may be closed at its outer end. Each of the exterior portions of the plugs 26 is provided with a transverse aperture 28 which communicates with the hollow portion of the plug and is aligned substantially parallel to the longitudinal axis of the conical body portion 18. If desired, a lock nut 30 may be threaded on the plug 26 to ensure that it is tightly secured to the ring 24.

As shown in FIG. 4, an initiator mix 32 is disposed within the exterior portion of the plug 26, a starter mix 34 is located within the interior portion of the plug 26 and within a portion of the annular ring 24 adjacent the pyrotechnic sheets 20, and an igniter mix 36 is disposed within the remaining portion of the ring 24. The initiator mix 32 may be composed of Atlas match composition, which is lead styphnate, the starter 34 may be composed of barium chromate and boron, and the igniter mix may be composed of copper oxide, aluminum, and a binder. As the pyrotechnic missile 10 enters altitudes between 150,000 to 50,000 feet the heat due to air friction on the exterior portion of the plug 26 and at the aperture 28 will cause the match composition to ignite which will successively ignite the starter mix 34 and the igniter mix 36. The pyrotechnic sheets 20 are composed of a binder, cesium dichromate or barium chromate, cesium nitrate, boron, and a metal fuel selected from the group consisting essentially of aluminum, magnesium, beryllium, and lithium. The binder may be Vistanex which is polyisobutylene and the metal fuel is preferably aluminum. The aforementioned ingredients for the pyrotechnic sheets 20 were mixed in various proportions as illustrated in the six examples of Table I:

TABLE I

| PYROTECHNIC SHEETS 20 (Percent Composition) | | | | | |
|---|---|---|---|---|---|
| Example No. | Vistanex (L-80) | $Cs_2Cr_2O_7$ (−325 Mesh) | $CsNO_3$ (−325 Mesh) | B (Amorphous 90-92%) | Al (Atomized 400) |
| 1 | 4.75 | 38.1 | 38.1 | 4.75 | 14.3 |
| 2 | 5.66 | 37.72 | 37.72 | 4.73 | 14.17 |
| 3 | 4.75 | 19.05 | 57.15 | 4.75 | 14.3 |
| 4 | 5.22 | 37.91 | 37.91 | 4.74 | 14.22 |
| 5 | 4.75 | 28.55 | 47.65 | 4.75 | 14.3 |
| 6 | 4.99 | 38.0 | 38.0 | 4.75 | 14.26 |

It is important that the pyrotechnic sheets be ignitable and burn well in the vacuum environment in altitudes between 150,000 to 50,000 feet and while burning produce a high yield of electrons. Further, it is important that these pyrotechnic sheets retain their sheetlike qualities, that is that they remain in sheet form on the conical body portion 18 during the burning phase. Each of the tests in examples 1 through 6 were conducted with a pyrotechnic sheet or sheets 20 on a conical missile body portion. Most of these tests were performed without any bleed-in of air to simulate actual atmospheric conditions in the altitudes between 150,000 to 50,000 feet in order to find out the relative sensitivity of the various mixtures to vacuum ignition and sustained burning.

EXAMPLE 1

Four different tests were conducted utilizing the percentages of ingredients shown in Example 1 of Table I. In the first test two layers of pyrotechnic sheets 20 were utilized having an overall thickness of 120 mils and a height of approximately 1 in. The vacuum at the beginning of the test was approximately 1.0 mm Hg and the vacuum at the end of the test was 1.5 mm Hg. The burning time was 4 seconds per inch and the sample burned approximately ½ inch up the sample at 1600° F. The next test was two layers of pyrotechnic sheet 20 with a total thickness of 136 mils and a height of approximately 2 inches. The vacuum at the beginning of the test was 1.0 mm Hg and the pyrotechnic burned approximately 1 inch up the unit after which the pyrotechnic fell off. In the third test two layers of pyrotechnic sheets 20 were utilized with a total thickness of 130 mils and a height of approximately 1 inch. The vacuum at the beginning of the test was 1.0 mm Hg and the result was that the sample burned irregular and the sheet had cracks. In the fourth test two layers of pyrotechnic sheets 20 were utilized with a total thickness of 130 mils and a height of approximately 1 inch. The vacuum at the beginning of the test was 2.5 mm Hg and the vacuum at the end of the test was 30 mm Hg. The burning time was 10 seconds per inch and the sample burned ½ inch up at a temperature of 1400° F. After these tests it was decided that an increase in the percentage of binder was necessary to provide a pyrotechnic sheet which had increased cohesive quality during the burning phase.

EXAMPLE 2

Two tests were conducted utilizing the percentages of ingedients shown in Example 2 of Table I. In the first test two layers of pyrotechnic sheet 20 were utilized with a total thickness of 122 mils and an approximate height of 1 inch. The vacuum at the beginning of the test was 0.1 mm Hg and the vacuum at the end of the test was 20 mm Hg. The burning time was 20 seconds and one of the layers burned ¼ inch up at 1900° F. and the outer layer burned ¾ inch up at 1642° F. In the second test, two layers of pyrotechnic sheet were utilized with a total thickness of 120 mils and an approximate height of 2 inches. The vacuum at the beginning of the test was 1.9 mm Hg. The sample burned approximately 0.7 inches up the sample before going out. These tests indicated that the pyrotechnic sheets of this example were less sensitive to vacuum ignition and burning than the mixture of Example 1. This decrease in sensitivity was due to the increase in binder content. The cesium dichromate appeared to be causing the most problems in regard to sheet properties and it was decided to try a lower percentage of cesium dichromate while maintaining the binder content at 4.75%. This approach had the possibility of retaining the vacuum ignition and burning sensitivity of the mixture of Example 1 while producing more desirable sheet properties. With this approach in mind the mixture of Example 3 was blended and tested.

EXAMPLE 3

Two tests were conducted utilizing the percentages of ingredients shown in Example 3 of Table I. In the first test two layers of pyrotechnic sheet 20 were utilized with thicknesses of 75 mils and 65 mils respectively and approximate heights of 1 inch and ¾ inch respectively. The vacuum at the beginning of the test was 1.0 mm Hg. The sample burned approximately ¾ inch up before going out. In the second test, the height of the sample was approximately 1 inch. The vacuum at the beginning of the test was 1.0 mm Hg and the vacuum at the end of the test was approximately 88.0 mm Hg. The entire sample ignited and burned satisfactorily at a temperature of 1600° F. In this latter test air was bled-in over a 10 second period to reach 88.0 mm Hg. These tests show that the lowering of the percentage of cesium dichromate had the effect of lowering the sensitivity of the pyrotechnic sheets to vacuum ignition and burning. The sheets would ignite but would not burn completely without the bleed-in of air. In Example 4 it was decided to lower the binder content to 5.22% since it was considered that this amount of binder would be sufficient to produce good sheet properties with the desired sensitivity.

EXAMPLE 4

Two tests were conducted utilizing the ingredients shown in Example 4 of Table I. In the first test two layers of pyrotechnic sheets 20 were utilized with a total thickness of 115 mils and an approximate height of 1 inch. The vacuum at the beginning of the test was 1.0 mm Hg. The sample burned approximately ¾ inch up and the temperature at the base of the sheet was 1350° F. In the second test, two layers of pyrotechnic sheets 20 were utilized with a total thickness of 120 mils and a height of approximately 2 inches. The vacuum at the beginning of the test was 1.0 mm Hg and the vacuum at the end of the test was 90 mm Hg. In this test the sample burned completely with the temperature at the base of the sample at 2200° F. and the temperature at the top thereof at 1560° F. The results of these tests indicated that the 5.22% binder in the mixture decreased the sensitivity from that of Example 1, but, with the required air bleed-in during the test to create the vacuum environment of reentry from 150,000 feet to 50,000 feet, the blend was very satisfactory. The sheet properties of the mixture of Example 4 were better than those of Example 1. In Example 5 it was decided to explore the possibility of lowering the 38.1% cesium dichromate in Example 1 in order to acquire good sheet properties and yet still maintain the vacuum ignition and burning sensitivity of the mixture of Example 1.

EXAMPLE 5

One test was conducted with the percentages of ingredients shown in Example 5 of Table I. In this test, two layers of pyrotechnic sheets 20 were utilized with a total thickness of 58 mils and 60 mils respectively and heights of approximately 1 inch. The vacuum at the beginning of the test was 1.0 mm Hg. This sample went out approximately ½ inch of the way up at a temperature of 455° F. Even though this sample did not burn completely it is speculated that with the normal bleed-in of air it might have been successful. At this time, it was decided that a minor increase in binder from 4.75% to 4.99% in Example 6 might be sufficient to give good sheet properties and yet retain the vacuum ignition and burning sensitivity of the mixture of Example 1.

EXAMPLE 6

Two tests were conducted with the percentages of ingredients shown in Example 6 of Table I. In the first test four layers of pyrotechnic sheets 20 were utilized with a total thickness of 230 mils and an approximate height of 2 inches. The vacuum at the beginning of the test was 1.0 mm Hg. There was poor ignition of this sample which was probably due to insufficient igniter mix to get the sample ignited. In the second test two layers of pyrotechnic sheets 20 were utilized with thicknesses of 75 mils and 65 mils respectively and approximate heights of 1 inch and ¾ inch respectively. The vacuum at the beginning of the test was 1.0 mm Hg and no air was bled in. This sample burned approximately ¾ inch up before going out. This second test indicated a good mixture.

Similar tests were conducted using barium chromate in lieu of cesium dichromate and substantially the same results were achieved in obtaining desired electron emission. Apparently the heavier alkaline metals will provide electron emission and allow the desired burning. Two other heavy alkaline metals which would be satisfactory are rubidium or strotrium. Cesium dichromate or barium chromate, however, are preferable.

We have found that by utilizing additional pyrotechnic sheets 22 of a different mixture than the pyrotechnic sheets 20 an increase in electron output can be obtained over just using the pyrotechnic sheets 20 alone. However, the pyrotechnic sheets 22, which form an inner thermal barrier and exterior inhibitor layer, must be supported for sustained burning by the burning of the pyrotechnic sheets 20. The pyrotechnic sheets 22 include a binder, cesium nitrate, and a metal fuel selected from the group consisting essentially of aluminum, magnesium, beryllium, and lithium. The binder may be Vistanex, as described hereinabove, and the metal fuel may be alumimum. Five examples of various percentages of these ingredients are illustrated hereinbelow in Table II.

TABLE II

| PYROTECHNIC SHEETS 22 (Percent Composition) | | | |
|---|---|---|---|
| Example No. | Binder (Vistanex L-80) | $CsNO_3$ (−325) | Al (Atomized 400) |
| 7 | 5 | 80.75 | 14.25 |
| 8 | 4 | 81.5 | 14.5 |
| 9 | 3 | 70 | 27 |

TABLE II-continued

| PYROTECHNIC SHEETS 22 (Percent Composition) | | | |
|---|---|---|---|
| Example No. | Binder (Vistanex L-80) | $CsNO_3$ (−325) | Al (Atomized 400) |
| 10 | 3 | 60 | 37 |
| 11 | 3 | 50 | 47 |

EXAMPLE 7

One test was conducted with the ingredients of Example 7 of Table II. The thermal barrier pyrotechnic sheet 22 was of a thickness of 25 mils and an approximate height of 2 inches and the inhibitor layer pyrotechnic sheet 22 was of a thickness of 19 mils with an approximate heights of 1 inch located at the top of the sample. Sandwiched between these sheets 22 were three layers of the pyrotechnic sheets 20 of the mixture of Example 4 with a total thickness of 166 mils and an approximate height of 2 inches. The vacuum at the beginning of the test was 1.0 mm Hg and the vacuum at the end of the test was 90 mm Hg. This sample completely burned within 16 seconds with a temperature of 2200° F. at 0.1 inches up and 2155° F. at 1.5 inches up.

EXAMPLE 8

One test was conducted with the ingredients of Example 8 in Table II. In this test the thermal barrier sheet 22 had a thickness of 27 mils and an approximate height of 2 inches, and the inhibitor layer sheet 22 had a thickness of 25 mils and an approximate height of 1 inch located at the top of the sample. Sandwiched between these sheets 22 were three layers of the pyrotechnic sheets 20 of the mixture of Example 2 with a total thickness of 194 mils and a height of approximately 2 inches. The vacuum at the beginning of the test was 1.0 mm Hg and the vacuum at the end of the test was 88 mm Hg. This sample burned completely in 10.6 seconds with a temperature of 2830° F. at 0.8 inches up and 2130° F. across the top of the sample. The tests of examples 7 and 8 confirmed our expectations that the combination of pyrotechnic sheets 20 and 22 produced increased electron density over the pyrotechnic sheets 20 alone since there was a decrease in burning time and increase in flame temperatures, and since there was a burning of the inhibitor layer sheet 22 and a partial burning of the thermal layer sheet 22. This lead to the decision to try to increase the sensitivity of the mixture to vacuum ignition and burning over the mixtures of examples 7 and 8 by decreasing the percentages of binder and cesium nitrate and increasing the percentage of aluminum. This would allow an increase in the sheet thickness and/or the number of sheets of the pyrotechnic sheet 22 as an inhibitor, which would significantly increase the overall electron density produced.

EXAMPLE 9

One test was conducted with the percentages of ingredients as shown in Example 9 of Table II. Three layers of pyrotechnic sheets 22 were utilized with a total thickness of 115 mils and a height of approximately 1 inch. The vacuum at the beginning of the test was 2 mm Hg. The sample did not burn.

EXAMPLE 10

One test was conducted with the percentages of ingredients as shown in Example 10 of Table II. Three layers of pyrotechnic sheets 22 were utilized with a total thickness of 135 mils and a height of approximately 1 inch. The vacuum at the beginning of the test was 2 mm Hg. The sample did not burn.

EXAMPLE 11

One test was conducted with the percentages of ingredients as shown in Example 11 of Table II. Three layers of pyrotechnic sheets 22 were utilized with a total thickness of 138 mils and a height of approximately 1 inch. The vacuum at the beginning of the test was 2 mm Hg. This sample may have burned slightly.

The relative sensitivity of the mixtures of Examples 9, 10, and 11 cannot be determined since none of the blends ignited and burned. However, the blend of Example 11 was chosen for the inhibitor and thermal layer sheets 22 since it had the most rapid burning rate in the atmosphere. Subsequently two tests were conducted with the mixture of Example 11 as the thermal and inhibitor layer sheets 22 with three layers of pyrotechnic sheets 20 of the blend of Example 2 of Table I. Both of these samples burned satisfactorily.

In blending and rolling the pyrotechnic sheets according to the mixtures described hereinabove a four-neck resin kettle was used to facilitate the ease of removal of the pyrotechnic mixture which was somewhat gummy. First, a solution containing the binder was added to the resin kettle. The remaining ingredients, which were in dry powder form, were added individually and slowly to this solution. The solution was vigorously stirred for approximately 15 min. with an air stirrer while the dry ingredients were added. The solvent from the solution was distilled by means of a steam bath and condenser into a flask. This distillation process took about 30 minutes and was continued until 70% to 75% of the solvent was removed. At this stage the mixture is almost too viscous to stir. The entire procedure up to this point was carried out in a moisture-free atmosphere. A drying tube was connected to the condenser to keep out the moist air. The hot viscous mixture was then removed from the steam bath and spatulae blended in the resin kettle to get rid of most of the remaining solvent.

The pyrotechnic mixture was then cooled in a desiccator and rolled into sheets of approximately 70 mil thickness in an undried form. The undried sheets were dried in a vacuum oven at 75° C. at 28 inches Hg for ½ hour and cooled in the desiccator. The dried sheets were repressed to squeeze the original thickness down to approximately 50 to 60 mil. The pyrotechnic sheets were stored in a desiccator and were then ready for loading on the conical body portion 18.

It is readily apparent that the present invention provides a unique pyrotechnic missile which will burn in a vacuum environment to produce an abundance of electrons. Provision has been made for automatically igniting pyrotechnic sheets on the missile body in response to heat caused by air friction at predetermined altitudes. One set of pyrotechnic sheets have been provided which will ignite and burn in the vacuum environment to produce a high yield of electrons and additional pyrotechnic sheets, with a higher yield of electrons, have been provided so that the combination of pyrotechnic sheets produce still a higher yield of electrons.

Obviously many modifications and variations of the present invention are possible in the light of the above teachings. It is therefore to be understood that within the scope of the appended claims the invention may be practiced otherwise than as specifically described.

We claim:

1. A pyrotechnic missile comprising:
a body;
a pyrotechnic sheet disposed on said body;
said pyrotechnic sheet including:
a binder,
a compound selected from the group consisting of cesium dichromate and barium chromate,
cesium nitrate,
boron, and
a metal fuel selected from the group consisting of aluminum, magnesium, berrilium, and lithium.

2. A pyrotechnic missile as claimed in claim 1 including:
a second pyrotechnic sheet disposed on said body adjacent the first mentioned pyrotechnic sheet; and
said second pyrotechnic sheet including:
a binder,
cesium nitrate, and
a metal fuel selected from the group consisting of aluminum, magnesium, berrilium and lithium.

3. A pyrotechnic missile as claimed in claim 2 comprising:
a pair of said second pyrotechnic sheets, and
the first pyrotechnic sheet being sandwiched between the pair of second pyrotechnic sheets.

4. A pyrotechnic missile as claimed in claim 3 wherein:
said body is substantially a conical portion; and including
an autoigniter mounted on said conical portion between its ends and adjacent the pyrotechnic sheets;
said autoigniter including:
a hollow ring,
a plurality of hollow plugs partially extending into the hollow ring and in communication therewith; and
each of said plugs having a portion exterior the ring, the exterior portion of each plug having a transverse aperture which communicates with the hollow portion of the plug, and which is aligned substantially parallel to the longitudinal axis of the conical body portion and
said ring and plugs being filled with an explosive material.

5. A pyrotechnic missile as claimed in claim 4 wherein:
the explosive material in the exterior portions of the plugs is an initiator mix which will ignite in response to temperature.

6. A pyrotechnic mixture comprising:
a binder;
a compound selected from the group consisting of cesium dichromate and barium chromate;
cesium nitrate;
boron; and
a metal fuel selected from the group consisting of aluminum, magnesium, berrilium, and lithium.

7. A pyrotechnic mixture as claimed in claim 6 wherein: the metal fuel is alumimum.

8. A pyrotechnic mixture as claimed in claim 7 wherein the ingredients of the mixture are substantially the following percentages by weight of said mixture:
1–6% binder;
30–60% of a compound selected from the group consisting of cesium dichromate and barium chromate;
0–30% cesium nitrate;
3–8% boron; and 10–20% aluminum.

9. A pyrotechnic mixture as claimed in claim 8 wherein the ingredients of the mixture are substantially the following percentages by weight of said mixture:

5% binder;

38% of a compound selected from the group consisting of cesium dichromate and barium chromate;

38% cesium nitrate;

4.75% boron; and 14.25% aluminum.

* * * * *